US009253574B2

(12) United States Patent
Thompson et al.

(10) Patent No.: US 9,253,574 B2
(45) Date of Patent: Feb. 2, 2016

(54) DIRECT-DIFFUSE DECOMPOSITION

(75) Inventors: Jeff Thompson, Bothell, WA (US); Brandon Smith, Kirkland, WA (US); Aaron Warner, Seattle, WA (US); Zoran Fejzo, Los Angeles, CA (US); Jean-Marc Jot, Aptos, CA (US)

(73) Assignee: DTS, Inc., Calabasas, CA (US)

( * ) Notice: Subject to any disclaimer, the term of this patent is extended or adjusted under 35 U.S.C. 154(b) by 339 days.

(21) Appl. No.: 13/612,543

(22) Filed: Sep. 12, 2012

(65) Prior Publication Data

US 2013/0182852 A1 Jul. 18, 2013

Related U.S. Application Data

(60) Provisional application No. 61/534,235, filed on Sep. 13, 2011, provisional application No. 61/676,791, filed on Jul. 27, 2012.

(51) Int. Cl.

| | |
|---|---|
| ***H04R 5/04*** | (2006.01) |
| ***G10L 19/008*** | (2013.01) |
| ***H04S 3/00*** | (2006.01) |
| *G10L 25/06* | (2013.01) |
| *G10L 21/0308* | (2013.01) |

(52) U.S. Cl.

CPC ..... *H04R 5/04* (2013.01); *G10L 19/008* (2013.01); *H04S 3/00* (2013.01); *G10L 21/0308* (2013.01); *G10L 25/06* (2013.01)

(58) Field of Classification Search

None

See application file for complete search history.

(56) References Cited

U.S. PATENT DOCUMENTS

| | | | | |
|---|---|---|---|---|
| 5,185,805 | A * | 2/1993 | Chiang | 381/96 |
| 7,412,380 | B1 * | 8/2008 | Avendano et al. | 704/216 |
| 2007/0253574 | A1 | 11/2007 | Soulodre | |
| 2007/0269063 | A1 * | 11/2007 | Goodwin et al. | 381/310 |
| 2008/0175394 | A1 * | 7/2008 | Goodwin | 381/1 |
| 2008/0205676 | A1 * | 8/2008 | Merimaa et al. | 381/310 |
| 2008/0247558 | A1 * | 10/2008 | Laroche et al. | 381/66 |
| 2009/0080666 | A1 | 3/2009 | Uhle et al. | |
| 2009/0092258 | A1 | 4/2009 | Merimaa et al. | |
| 2009/0198356 | A1 * | 8/2009 | Goodwin et al. | 700/94 |
| 2009/0234657 | A1 | 9/2009 | Takagi | |

(Continued)

FOREIGN PATENT DOCUMENTS

| | | |
|---|---|---|
| CN | 101981811 A | 2/2011 |
| WO | 2011086060 | 7/2011 |

OTHER PUBLICATIONS

World Intellectual Property Organization, International Search Report and Written Opinion for International Application No. PCT/US2012/055103, mail date Dec. 18, 2012, pp. 1-10.

(Continued)

*Primary Examiner* — Brenda Bernardi

(74) *Attorney, Agent, or Firm* — SoCal IP Law Group LLP; John E. Gunther

(57) ABSTRACT

There is disclosed methods and apparatus for decomposing a signal having a plurality of channels into direct and diffuse components. The correlation coefficient between each pair of signals from the plurality of signals may be estimated. A linear system of equations relating the estimated correlation coefficients and direct energy fractions of each of the plurality of channels may be constructed. The linear system may be solved to estimate the direct energy fractions. A direct component output signal and a diffuse component output signal may be generated based in part on the direct energy fractions.

20 Claims, 5 Drawing Sheets

(56) References Cited

U.S. PATENT DOCUMENTS

| | | | | |
|---|---|---|---|---|
| 2009/0252341 | A1 | 10/2009 | Goodwin | |
| 2010/0150375 | A1 | 6/2010 | Buck | |
| 2010/0241438 | A1* | 9/2010 | Oh et al. | 704/500 |
| 2010/0296672 | A1* | 11/2010 | Vickers | 381/119 |
| 2011/0013790 | A1 | 1/2011 | Hilpert | |
| 2011/0305345 | A1* | 12/2011 | Bouchard et al. | 381/23.1 |
| 2012/0314876 | A1* | 12/2012 | Vilkamo et al. | 381/22 |
| 2013/0268281 | A1* | 10/2013 | Walther | 704/500 |

OTHER PUBLICATIONS

Harma, Estimation of the Energy Ratio Between Primary and Ambience Components in Stereo Audio Data, article, 19th European Signal Processing Conference (EUSIPCO 2011) in Barcelona, Spain, Aug. 29-Sep. 2, 2011, pp. 1643-1647 including search history pp. 1-4, 9 total pages.

State Intellectual Property Office of the People's Republic of China, Notice of the First Office Action for Application No. 201280050756.6, mail date Feb. 17, 2015, 9 total pages.

Aki Harma, Estimation of the Energy Ratio Between Primary and Ambiance Components in Stereo Audio Data, URL: http://www.eurasip.org/proceedings/Eusipeo/Eusipeo2011/papers/1569424433.pdf, pp. 1643-1647, 19th European Signal Proceeding Conference, published Sep. 2, 2011, 5 total pages.

European Patent Office, Extended European Search Report and Written Opinion received for European Application No. 12831014.1, mail date May 4, 2015, 6 total pages.

Aki Harma, Estimation of the Energy Ratio Between Primary and Ambience Components in Stereo Audio Data, Journal in the 19th European Signal Processing Conference held in Barcelona, Spain, Sep. 2, 2011, URL:http://resolver.tudelft.nl/uuid:50c6c4d1-f963-441a-b08f-fa4cc89a5cd2, last accessed Oct. 7, 2014, 5 total pages.

* cited by examiner

DIRECT-DIFFUSE DECOMPOSITION

RELATED APPLICATION INFORMATION

This patent claims priority from the following provisional patent applications: Provisional Patent Application No. 61/534,235, entitled Direct/Diffuse Decomposition, filed Sep. 13, 2011, and Provisional Patent Application No. 61/676,791, entitled Direct/Diffuse Decomposition, filed Jul. 27, 2012.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to audio signal processing and, in particular, to methods for decomposing audio signals into direct and diffuse components.

2. Description of the Related Art

Audio signals commonly consist of a mixture of sound components with varying spatial characteristics. For a simple example, the sounds produced by a solo musician on a stage may be captured by a plurality of microphones. Each microphone captures a direct sound component that travels directly from the musician to the microphone, as well as other sound components including reverberation of the sound produced by the musician, audience noise, and other background sounds emanating from an extended or diffuse source. The signal produced by each microphone may be considered to contain a direct component and a diffuse component.

In many audio signal processing applications it is beneficial to separate a signal into distinct spatial components such that each component can be analyzed and processed independently. In particular, separating an arbitrary audio signal into direct and diffuse components is a common task. For example, spatial format conversion algorithms may process direct and diffuse components independently so that direct components remain highly localizable while diffuse components preserve a desired sense of envelopment. Also, binaural rendering methods may apply independent processing to direct and diffuse components where direct components are rendered as virtual point sources and diffuse components are rendered as a diffuse sound field. In this patent, separating a signal into direct and diffuse components will be referred to as "direct-diffuse decomposition".

The terminology used in this patent may differ slightly from terminology employed in the related literature. In related papers, direct and diffuse components are commonly referred to as primary and ambient components or as nondiffuse and diffuse components. This patent uses the terms "direct" and "diffuse" to emphasize the distinct spatial characteristics of direct and diffuse components; that is, direct components generally consist of highly directional sound events and diffuse components generally consist of spatially distributed sound events. Additionally, in this patent, the terms "correlation" and "correlation coefficient" refer to a normalized cross-correlation measure between two signals evaluated with a time-lag of zero.

Throughout this description, elements appearing in figures are assigned three-digit reference designators, where the most significant digit is the figure number where the element is introduced and the two least significant digits are specific to the element. An element that is not described in conjunction with a figure may be presumed to have the same characteristics and function as a previously-described element having the same reference designator.

DETAILED DESCRIPTION

Description of Methods

Figure 1:
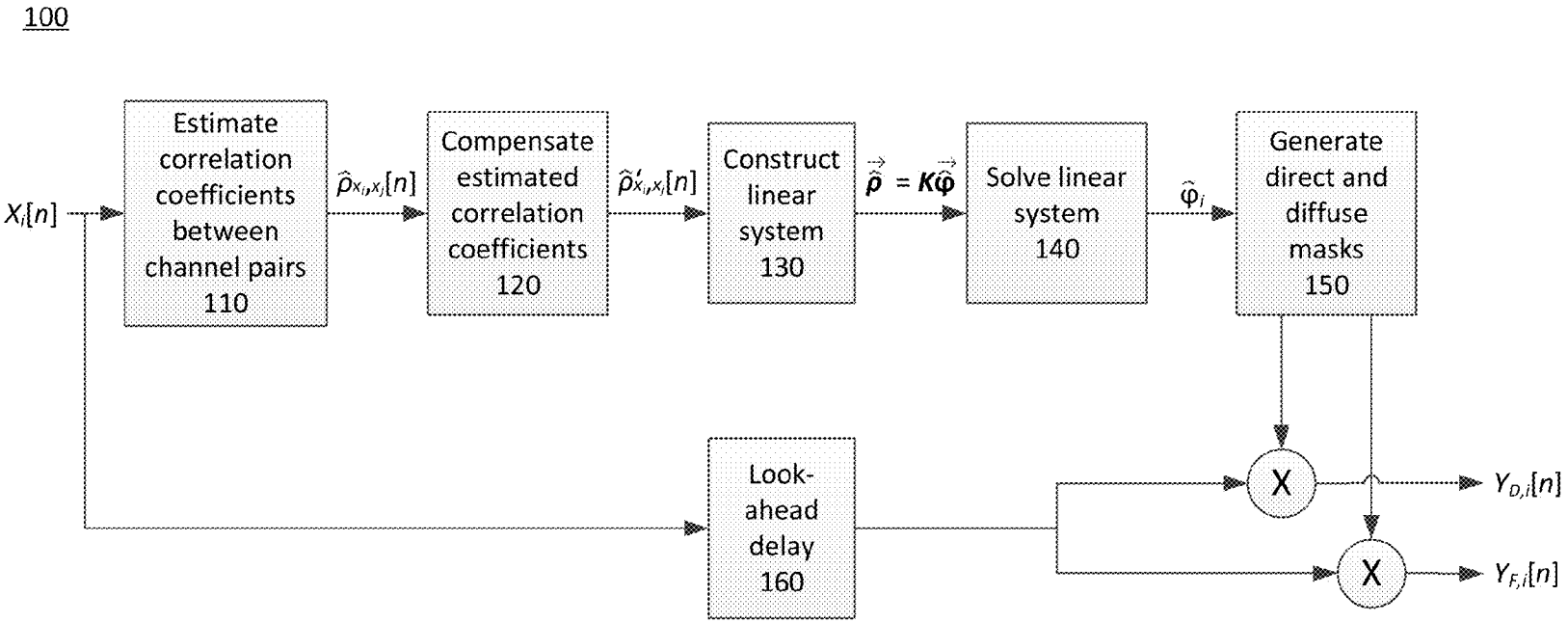
FIG. 1 is a flow chart of a process for direct-diffuse decomposition.

FIG. 1 is a flow chart of a process 100 for direct-diffuse decomposition of an input signal $X_i[n]$ including a plurality of channels. The input signal $X_i[n]$ may be a complex N-channel audio signal represented by the following signal model $$X_i[n]=a_i e^{j\theta_i} D[n]+b_i F_i[n] \tag{1}$$

where D[n] is the direct basis, $F_i[n]$ is the diffuse basis, $a_i^2$ is the direct energy, $b_i^2$ is the diffuse energy, $\theta_i$ is the direct component phase shift, i is the channel index, and n is the time index. In the remainder of this patent the term "direct component" refers to $a_i e^{j\theta_i} D[n]$ and the term "diffuse component" refers to $b_i F_i[n]$. It is assumed that for each channel the direct and diffuse bases are complex zero-mean stationary random variables, the direct and diffuse energies are real positive constants, and the direct component phase shift is a constant value. It is also assumed that the expected energy of the direct and diffuse bases is unity for all channels without loss of generality $$E\{|D|^2\}=E\{|F_i|^2\}1 \tag{2}$$

where $E\{\bullet\}$ denotes the expected value. Although the expected energy of the direct and diffuse bases is assumed to be unity, the scalars $a_i$ and $b_i$ allow for arbitrary direct and diffuse energy levels in each channel. While it is assumed that direct and diffuse components are stationary for the entire signal duration, practical implementations divide a signal into time-localized segments where the components within each segment are assumed to be stationary.

A number of assumptions may be made about the spatial properties of the direct and diffuse components. Specifically, it may be assumed that the direct components are correlated across the channels of the input signal while the diffuse components are uncorrelated both across channels and with the direct components. The assumption that direct components are correlated across channels is represented in Eq. (1) by the single direct basis D[n] that is identical across channels unlike the channel dependent energies $a_i^2$ and phase shifts $\theta_i$. The assumption that the diffuse components are uncorrelated is represented in Eq. (1) by the unique diffuse basis $F_i[n]$ for each channel. Based on the assumption that the direct and diffuse components are uncorrelated the expected energy of the mixture signal $X_i[n]$ is $$E\{|X_i|^2\}=a_i^2+b_i^2 \tag{3}$$

Note that this signal model is independent of channel locations; that is, no assumptions are made based on specific channel locations.

The correlation coefficient between channels i and j is defined as $$\rho_{X_i,X_j}=\frac{E\{X_iX_j^*\}}{\sigma_{X_i}\sigma_{X_j}} \tag{4}$$

where $(\bullet)^*$ denotes complex conjugation and $\sigma_{X_i}$ and $\sigma_{X_j}$ are the standard deviations of channels i and j, respectively. In general, the correlation coefficient is complex-valued. The magnitude of the correlation coefficient has the property of being bounded between zero and one, where magnitudes tending towards one indicate that channels i and j are correlated while magnitudes tending towards zero indicate that channels i and j are uncorrelated. The phase of the correlation coefficient indicates the phase difference between channels i and j.

Applying the direct-diffuse signal model of Eq. (1) to the correlation coefficient of Eq. (4) yields $$\rho_{X_i,X_j}=\frac{\gamma_{ij}}{\sqrt{\gamma_{ii}\gamma_{jj}}} \tag{5}$$

where $$\gamma_{ij}=E\{(a_ie^{j\theta_i}D+b_iF_i)(a_je^{j\theta_j}D+b_jF_j)^*\}$$

$$\gamma_{ii}=E\{(a_ie^{j\theta_i}D+b_iF_i)(a_ie^{j\theta_i}D+b_iF_i)^*\}$$

$$\gamma_{jj}=E\{(a_ie^{j\theta_j}D+b_jF_j)(a_je^{j\theta_j}D+b_jF_j)^*\} \tag{6}$$

As previously described, the direct components may be assumed to be correlated across channels and the diffuse components may be assumed to be uncorrelated both across channels and with the direct components. These spatial assumptions can be formally expressed in terms of the correlation coefficient between channels i and j as $$|\rho_{D,D}|=1$$

$$|\rho_{F_i,F_j}|=0$$

$$|\rho_{D,F_j}|=0 \tag{7}$$

The magnitude of the correlation coefficient for the direct-diffuse signal model can be derived by applying the direct and diffuse energy assumptions of Eq. (2) and the spatial assumptions of Eq. (7) to Eq. (5) yielding $$|\rho_{X_i,X_j}|=\frac{a_ia_j}{\sqrt{(a_i^2+b_i^2)(a_j^2+b_j^2)}} \tag{8}$$

It is clear that the magnitude of the correlation coefficient for the direct-diffuse signal model depends only on the direct and diffuse energy levels of channels i and j.

Similarly, the phase of the correlation coefficient for the direct-diffuse signal model can be derived by applying the direct-diffuse spatial assumptions yielding $$\angle\rho_{x_i,x_j}=\theta_i-\theta_j \tag{9}$$

It is clear that the phase of the correlation coefficient for the direct-diffuse signal model depends only on the direct component phase shifts of channels i and j.

Correlation coefficients between pairs of channels may be estimated at 110. A common formula for the correlation coefficient estimate between channels i and j is given as $$\hat{\rho}_{X_i,X_j}=\frac{\frac{1}{T}\sum_{n=0}^{T-1}X_i[n]X_j^*[n]}{\sqrt{\left|\frac{1}{T}\sum_{n=0}^{T-1}X_i[n]X_i^*[n]\right|\left|\frac{1}{T}\sum_{n=0}^{T-1}X_j[n]X_j^*[n]\right|}} \tag{10}$$

where T denotes the length of the summation. This equation is intended for stationary signals where the summation is carried out over the entire signal length. However, real-world signals of interest are generally non-stationary, thus successive time-localized correlation coefficient estimates may be preferred using an appropriately short summation length T. While this approach can sufficiently track time-varying direct and diffuse components, it requires true-mean calculations (i.e. summations over the entire time interval T), resulting in high computational and memory requirements.

A more efficient approach that may be used at 110 is to approximate the true-means using exponential moving averages as $$\hat{\rho}_{X_i,X_j}[n]=\frac{r_{ij}[n]}{\sqrt{r_{ii}[n]r_{jj}[n]}} \tag{11}$$

where $$r_{ij}[n]=\lambda r_{ij}[n-1]+(1-\lambda)X_i[n]X_j^*[n]$$

$$r_{ii}[n]=\lambda r_{ii}[n-1]+(1-\lambda)X_i[n]X_i^*[n]$$

$$r_{jj}[n]=\lambda r_{jj}[n-1]+(1-\lambda)X_i[n]X_j^*[n] \tag{12}$$

and $\lambda$ is a forgetting factor in the range [0, 1] that controls the effective averaging length of the correlation coefficient estimates. This recursive formulation has the advantages of requiring less computational and memory resources compared to the method of Eq. (10) while maintaining flexible control over the tracking of time-varying direct and diffuse components. The time constant $\tau$ of the correlation coefficient estimates is a function of the forgetting factor $\lambda$ as $$\tau=-\frac{1}{f_c\ln(1-\lambda)} \tag{13}$$

where $f_c$ is the sampling rate of the signal $X_i[n]$ (for time-frequency implementations $f_c$ is the effective subband sampling rate).

The magnitude of correlation coefficient estimates may be considerably overestimated when computed with the recursive formulation using a small forgetting factor $\lambda$. This bias towards one is due to the relatively high weighting of the current time sample compared to the signal history, noting that the magnitude of the correlation coefficient is equal to one for a summation length T=1 or a forgetting factor $\lambda$=0. The estimated correlation coefficients may be optionally compensated at 120 based on empirical analysis of the overestimation as a function of the forgetting factor $\lambda$ as follows $$|\hat{\rho}'_{x_i,x_j}[n]| = \max\left\{0,\ 1 - \frac{1 - |\hat{\rho}'_{x_i,x_j}[n]|}{\lambda}\right\} \tag{14}$$

where $|\hat{\rho}'_{x_i,x_j}[n]|$ is the compensated magnitude of the correlation coefficient estimate. This compensation method is based on the empirical observation that the range of the average correlation coefficient is compressed from [0, 1] to approximately [1−λ, 1]. Thus, the compensation method linearly expands correlation coefficients in the range of [1−λ, 11] to [0, 1], where coefficients originally below 1−λ are set to zero by the max{•} operator.

At 130, a linear system may be constructed from the pairwise correlation coefficients for all unique channel pairs and the Direct Energy Fractions (DEF) for all channels of a multichannel signal. The DEF $\phi_i$ for the i-th channel is defined as the ratio of the direct energy to the total energy $$\varphi_i = \frac{a_i^2}{a_i^2 + b_i^2} \tag{15}$$

It is clear from Eqs. (8) and (15) that the correlation coefficient for a pair of channels i and j is directly related to the DEFs of those channels as $$|\rho_{x_i,x_j}| = \sqrt{\phi_i \phi_j} \tag{16}$$

Applying the logarithm yields $$\log(|\rho_{x_i,x_j}|) = \frac{\log(\varphi_i) + \log(\varphi_j)}{2} \tag{17}$$

For a multichannel signal with an arbitrary number of channels N there are $$M = \frac{N(N-1)}{2}$$

number of unique channels pairs (valid for N≥2). A linear system can be constructed from the M pairwise correlation coefficients and the N per-channel DEFs as $$\begin{bmatrix} \log(|\rho_{x_1,x_2}|) \\ \log(|\rho_{x_1,x_3}|) \\ \log(|\rho_{x_1,x_4}|) \\ \vdots \\ \log(|\rho_{x_{N-1},x_N}|) \end{bmatrix} = \begin{bmatrix} 0.5 & 0.5 & 0 & 0 & \dots & 0 \\ 0.5 & 0 & 0.5 & 0 & \dots & 0 \\ 0.5 & 0 & 0 & 0.5 & \dots & 0 \\ \vdots & \vdots & \vdots & \vdots & \ddots & \vdots \\ 0 & 0 & 0 & \dots & 0.5 & 0.5 \end{bmatrix} \begin{bmatrix} \log(\varphi_1) \\ \log(\varphi_2) \\ \log(\varphi_3) \\ \vdots \\ \log(\varphi_N) \end{bmatrix} \tag{18}$$

or expressed as a matrix equation $$\vec{\rho} = K\vec{\phi} \tag{19}$$

where $\vec{\rho}$ is a vector of length M consisting of the log-magnitude pairwise correlation coefficients for all unique channel pairs i and j, K is a sparse matrix of size M×N consisting of non-zero elements for row/column indices that correspond to channel-pair indices, and $\vec{\phi}$ is a vector of length N consisting of the log per-channel DEFs for each channel i.

As an example, the linear system for a 5-channel signal can be constructed at 130 as $$\begin{bmatrix} \log(|\rho_{x_1,x_2}|) \\ \log(|\rho_{x_1,x_3}|) \\ \log(|\rho_{x_1,x_4}|) \\ \log(|\rho_{x_1,x_5}|) \\ \log(|\rho_{x_2,x_3}|) \\ \log(|\rho_{x_2,x_4}|) \\ \log(|\rho_{x_2,x_5}|) \\ \log(|\rho_{x_3,x_4}|) \\ \log(|\rho_{x_3,x_5}|) \\ \log(|\rho_{x_4,x_5}|) \end{bmatrix} = \begin{bmatrix} 0.5 & 0.5 & 0 & 0 & 0 \\ 0.5 & 0 & 0.5 & 0 & 0 \\ 0.5 & 0 & 0 & 0.5 & 0 \\ 0.5 & 0 & 0 & 0 & 0.5 \\ 0 & 0.5 & 0.5 & 0 & 0 \\ 0 & 0.5 & 0 & 0.5 & 0 \\ 0 & 0.5 & 0 & 0 & 0.5 \\ 0 & 0 & 0.5 & 0.5 & 0 \\ 0 & 0 & 0.5 & 0 & 0.5 \\ 0 & 0 & 0 & 0.5 & 0.5 \end{bmatrix} \begin{bmatrix} \log(\varphi_1) \\ \log(\varphi_2) \\ \log(\varphi_3) \\ \log(\varphi_4) \\ \log(\varphi_5) \end{bmatrix} \tag{20}$$

where there are 10 unique equations, one for each of the 10 pairwise correlation coefficients.

In typical scenarios, the true per-channel DEFs of an arbitrary N-channel audio signal are unknown. However, estimates of the pairwise correlation coefficients can be computed at 110 and 120 and then utilized to estimate the per-channel DEFs by solving, at 140, the linear system of Eq. (18).

Let $\hat{\rho}_{x_i,x_j}$ be the sample correlation coefficient for a pair of channels i and j; that is, an estimate of the formal expectation of Eq. (4). If the sample correlation coefficient is estimated for all unique channel pairs i and j, the linear system of Eq. (18) can be realized and solved at 140 to estimate the DEFs $\hat{\phi}_i$ for each channel i.

For a multichannel signal with N>3 there are more pairwise correlation coefficient estimates than per-channel DEF estimates resulting in an overdetermined system. Least squares methods may be used at 140 to approximate solutions to overdetermined linear systems. For example, a linear least squares method minimizes the sum squared error for each equation. The linear least squares method can be applied as $$\vec{\hat{\phi}} = (K^T K)^{-1} K^T \vec{\rho} \tag{21}$$

where $\vec{\hat{\phi}}$ is a vector of length N consisting of the log per-channel DEF estimates for each channel i, $\vec{\rho}$ is a vector of length M consisting of the log-magnitude pairwise correlation coefficient estimates for all unique channel pairs i and j, $(\bullet)^T$ denotes matrix transposition, and $(\bullet)^{-1}$ denotes matrix inversion. An advantage of the linear least squares method is relatively low computational complexity, where all necessary matrix inversions are only computed once. A potential weakness of the linear least squares method is that there is no explicit control over the distribution of errors. For example, it may be desirable to minimize errors for direct components at the expense of increased errors for diffuse components. If control over the distribution of errors is desired, a weighted least squares method can be applied where the weighted sum squared error is minimized for each equation. The weighted least squares method can be applied as $$\vec{\hat{\phi}} = (K^T W K)^{31\ 1} K^T W \vec{\rho} \tag{22}$$

where W is a diagonal matrix of size M×M consisting of weights for each equation along the diagonal. Based on desired behavior, the weights may be chosen to reduce approximation error for equations with certain properties (e.g. strong direct components, strong diffuse components, relatively high energy components, etc.). A weakness of the weighted least squares method is significantly higher computational complexity, where matrix inversions are required for each linear system approximation.

For a multichannel signal with N=3 there are an equal number of pairwise correlation coefficient estimates and per-channel DEF estimates resulting in a critical system. However, it is not guaranteed that the linear system will be consistent since the pairwise correlation coefficient estimates typically exhibit substantial variance. Similar to the overdetermined case, a linear least squares or weighted least squares method can be employed at 140 to compute an approximate solution even when the critical system is inconsistent.

For a 2-channel stereo signal with N=2 there are more per-channel DEF estimates than pairwise correlation coefficient estimates resulting in an under determined system. In this case, further signal assumptions are necessary to compute a solution such as equal DEF estimates or equal diffuse energy per channel.

After the DEFs for each channel have been estimated by solving the linear system at 140, the per-channel DEF estimates may be used at 150 to generate direct and diffuse masks. The term "mask" commonly refers to a multiplicative modification that is applied to a signal to achieve a desired amplification or attenuation of a signal component. Masks are frequently applied in a time-frequency analysis-synthesis framework where they are commonly referred to as "time-frequency masks". Direct-diffuse decomposition may be performed by applying a real-valued multiplicative mask to the multichannel input signal.

$Y_{D,i}[n]$ and $Y_{F,i}[n]$ are defined to be a direct component output signal and a diffuse component output signal, respectively, based on the multichannel input signal $X_i[n]$. From Eqs. (3) and (15), real-valued masks derived from the DEFs can be applied as $$Y_{D,i}[n]=\sqrt{\hat{\phi}_i}X_i[n]$$

$$Y_{F,i}[n]=\sqrt{1-\hat{\phi}_i}X_i[n] \tag{23}$$

such that the expected energies of the decomposed direct and diffuse components are approximately equal to the true direct and diffuse energies $$E\{|Y_{D,i}|^2\}\cong a_i^2$$

$$E\{|Y_{F,i}|^2\}\cong b_i^2 \tag{24}$$

In this case, $Y_{D,i}[n]$ is a multichannel output signal where each channel of $Y_{D,i}[n]$ has the same expected energy as the direct component of the corresponding channel of the multichannel input signal $X_i[n]$. Similarly, $Y_{F,i}[n]$ is a multichannel output signal where each channel of $Y_{F,i}[n]$ has the same expected energy as the diffuse component of the corresponding channel of the multichannel input signal $X_i[n]$.

While the expected energies of the decomposed direct and diffuse output signals approximate the true direct and diffuse energies of the input signal, the sum of the decomposed components is not necessarily equal to the observed signal, i.e. $X_i[n]\neq Y_{D,i}[n]+Y_{F,i}[n]$ for $0<\hat{\phi}_i<1$. Because real-valued masks are used to decompose the observed signal, the resulting direct and diffuse component output signals are fully correlated breaking the previous assumption that direct and diffuse components are uncorrelated.

If it is desired that the sum of the output signals $Y_{D,i}[n]$ and $Y_{F,i}[n]$ be equal to the observed input signal $X_i[n]$ then a simple normalization can be applied to the masks $$Y_{D,i}[n] = \frac{\sqrt{\hat{\varphi}_i}}{\sqrt{\hat{\varphi}_i} + \sqrt{1-\hat{\varphi}_i}} X_i[n] \tag{25}$$

-continued $$Y_{F,i}[n] = \frac{\sqrt{1-\hat{\varphi}_i}}{\sqrt{\hat{\varphi}_i} + \sqrt{1-\hat{\varphi}_i}} X_i[n]$$

Note that this normalization affects the energy levels of the decomposed direct component and diffuse component output signals such that Eq. (24) is no longer valid.

The direct component and diffuse component output signals $Y_{D,i}[n]$ and $Y_{F,i}[n]$, respectively, may be generated by multiplying a delayed copy of the multichannel input signal $X_i[n]$ with the direct and diffuse masks from 150. The multichannel input signal may be delayed at 160 by a time period equal to the processing time necessary to complete the actions 110-150 to generate the direct and diffuse masks. The direct component and diffuse component output signals may now be used in applications such as spatial format conversion or binaural rendering described previously.

Although shown as a series of sequential actions for ease of explanation, the process 100 may be performed by parallel processors and/or as a pipeline such that different actions are performed concurrently for multiple channels and multiple time samples.

A multichannel direct-diffuse decomposition process, similar to the process 100 of FIG. 1, may be implemented in a time-frequency analysis framework. In particular, the signal model established in Eq. (1)-Eq. (3) and the analysis summarized in Eq. (4)-Eq. (25) are considered valid for each frequency band of an arbitrary time-frequency representation.

A time-frequency framework is motivated by a number of factors. First, a time-frequency approach allows for independent analysis and decomposition of signals that contain multiple direct components provided that the direct components do not overlap substantially in frequency. Second, a time-frequency approach with time-localized analysis enables robust decomposition of non-stationary signals with time-varying direct and diffuse energies. Third, a time-frequency approach is consistent with psychoacoustics research that suggests that the human auditory system extracts spatial cues as a function of time and frequency, where the frequency resolution of binaural cues approximately follows the equivalent rectangular bandwidth (ERB) scale. Based on these factors, it is natural to perform direct-diffuse decomposition within a time-frequency framework.

Figure 2:
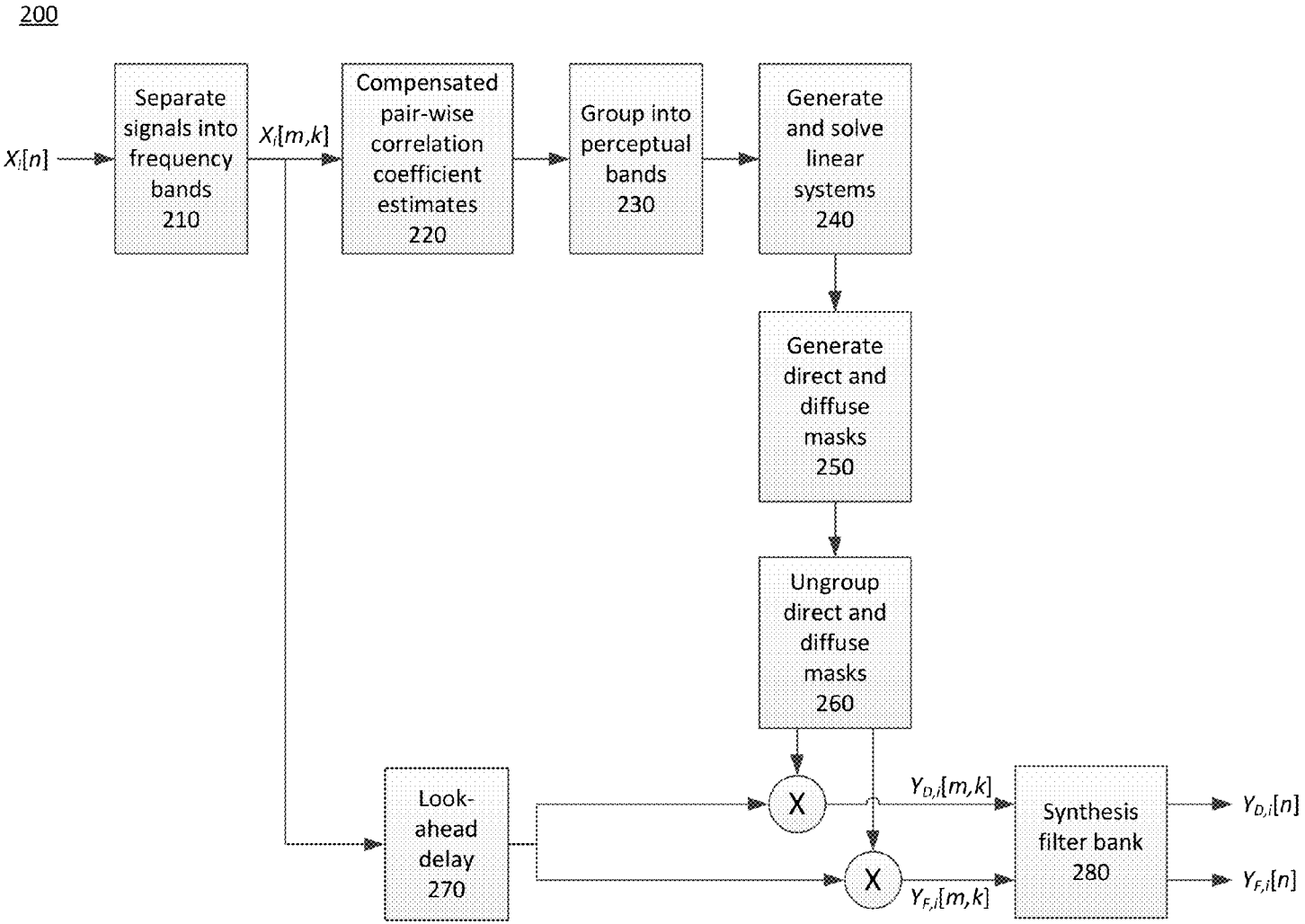
FIG. 2 is a flow chart of another process for direct-diffuse decomposition.

FIG. 2 is a flow chart of a process 200 for direct/diffuse decomposition of a multichannel signal $X_i[n]$ in a time-frequency framework. At 210, the multichannel signal $X_i[n]$ may be separated or divided into a plurality of frequency bands. The notation $X_i[m, k]$ is used to represent a complex time-frequency signal where m denotes the temporal frame index and k denotes the frequency index. For example, the multichannel signal $X_i[n]$ may be separated into frequency bands using a short-term Fourier transform (STFT). For further example, a hybrid filter bank consisting of a cascade of two complex-modulated quadrature mirror filter banks (QMF) may be used to separate the multichannel signal into a plurality of frequency bands. An advantage of the hybrid QMF is reduced memory requirements compared to the STFT due to a generally acceptable reduction of frequency resolution at high frequencies.

At 220, correlation coefficient estimates may be made for each pair of channels in each frequency band. Each correlation coefficient estimate may be made as described in conjunction with action 110 in the process 100. Optionally, each correlation coefficient estimate may be compensated as described in conjunction with action 120 in the process 100.

At 230, the correlation coefficient estimates from 220 may be grouped into perceptual bands. For example, the correlation coefficient estimates from 220 may be grouped into Bark bands, may be grouped according to an equivalent rectangular bandwidth scale, or may be grouped in some other manner into bands. The correlation coefficient estimates from 220 may be grouped such that the perceptual differences between adjacent bands are approximately the same. The correlation coefficient estimates may be grouped, for example, by averaging the correlation coefficient estimates for frequency bands within the same perceptual band.

At 240, a linear system may be generated and solved for each perceptual band, as described in conjunction with actions 130 and 140 of the process 100. At 250, direct and diffuse masks may be generated for each perceptual band as described in conjunction with action 150 in the process 100.

At 260, the direct and diffuse masks from 250 may be ungrouped, which is to say the actions used to group the frequency bands at 230 may be reversed at 260 to provide direct and diffuse masks for each frequency band. For example, if three frequency bands were combined at 230 into a single perceptual band, at 260 the mask for that perceptual band would be applied to each of the three frequency bands.

The direct component and diffuse component output signals $Y_{D,i}[m, k]$ and $Y_{F,i}[m, k]$, respectively, may be determined by multiplying a delayed copy of the multiband, multichannel input signal $X_i[m, k]$ with the ungrouped direct and diffuse masks from 260. The multiband, multichannel input signal may be delayed at 270 by a time period equal to the processing time necessary to complete the actions 220-260 to generate the direct and diffuse masks. The direct component and diffuse component output signals $Y_{D,i}[m, k]$ and $Y_{F,i}[m, k]$, respectively, may be converted to time-domain signals $Y_{D,i}[n]$ and $Y_{F,i}[n]$ by synthesis filter bank 280.

Although shown as a series of sequential actions for ease of explanation, the process 200 may be performed by parallel processors and/or as a pipeline such that different actions are performed concurrently for multiple channels and multiple time samples.

The process 100 and the process 200, using real-valued masks, work well for signals that consist entirely of direct or diffuse components. However, real-valued masks are less effective at decomposing signals that contain a mixture of direct and diffuse components because real-valued masks preserve the phase of the mixed components. In other words, the decomposed direct component output signal will contain phase information from the diffuse component of the input signal, and vice versa.

Figure 3:
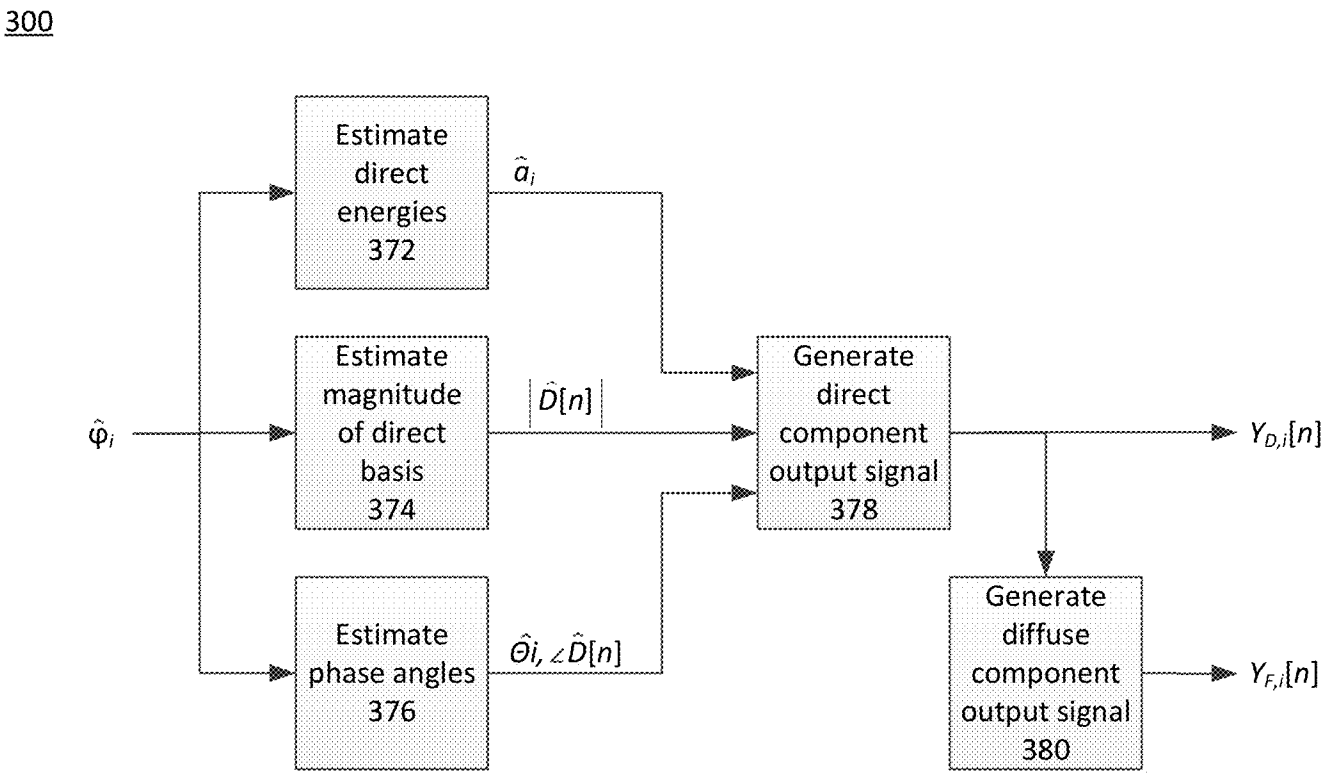
FIG. 3 is a flow chart of another process for direct-diffuse decomposition.

FIG. 3 is a flow chart of a process 300 for estimating direct component and diffuse component output signals based on DEFs of a multichannel signal. The process 300 starts after DEFs have been calculated, for example using the actions from 110 to 140 of the process 100 or the actions 210-240 of the process 200. In the latter case, the process 300 may be performed independently for each perceptual band. The process 300 exploits the assumption that the underlying direct component is identical across channels to fully estimate both the magnitude and phase of the direct component.

Let the decomposed direct component output signal $Y_{D,i}[n]$ be an estimate of the true direct component $a_i e^{j\theta_i} D[n]$ $$Y_{D,i}[n]=\hat{a}_i e^{j\hat{\theta}_i}\hat{D}[n] \tag{26}$$

where $\hat{D}[n]$ is an estimate of the true direct basis, $\hat{a}_i^2$ is an estimate of the true direct energy, and $\hat{\theta}_i$ is an estimate of the true direct component phase shift. It is assumed in the process 300 that the decomposed direct component output signal and the decomposed diffuse component output signal obey the original additive signal model, i.e. $X_i[n]=Y_{D,i}[n]+Y_{F,i}[n]$. For the purposes of this method, it is helpful to express the complex-valued direct basis estimate $\hat{D}[n]$ in polar form yielding $$Y_{D,i}[n]=\hat{a}_i|\hat{D}[n]|e^{j(\angle\hat{D}[n]+\hat{\theta}_i)} \tag{27}$$

where $|\hat{D}[n]|$ is an estimate of the true magnitude and $\angle\hat{D}[n]$ is an estimate of the true phase of the direct basis. The direct component output signal $Y_{D,i}[n]$ can be estimated by independently estimating the components $\hat{a}_i$, $|\hat{D}[n]$, $\angle\hat{D}[n]$, and $\hat{\theta}_i$.

At 372, the direct energy estimate $\hat{a}_i$ can be determined as $$\hat{a}_i=\sqrt{\hat{\varphi}_i\hat{\gamma}_{ii}} \tag{28}$$

where $\hat{\gamma}_{ii}$ is an estimate of the total energy of channel i as expressed in Eq. (6). From Eqs. (3) and (15) it is clear that the expected value of the estimated direct energy is approximately equal to the true direct energy, i.e. $E\{\hat{a}_i^2\}\cong a_i^2$.

At 374, the magnitude of the direct basis $|\hat{D}[n]|$ may be estimated. The direct and diffuse bases are random variables. While the expected energies of the direct and diffuse components are statistically determined by $a_i^2$ and $b_i^2$, the instantaneous energies for each time sample n are stochastic. The stochastic nature of the direct basis is assumed to be identical in all channels due to the assumption that direct components are correlated across channels. To estimate the instantaneous magnitude of the direct basis $|\hat{D}[n]|$, a weighted average of the instantaneous magnitudes of the observed signal $|X_i[n]|$ is computed across all channels i. By giving larger weights to channels with higher ratios of direct energy, the instantaneous magnitude of the direct basis can be estimated robustly with minimal influence from diffuse components as $$|\hat{D}[n]| = \frac{\sum_{i=1}^{N} \hat{\varphi}_i \frac{|X_i[n]|}{\sqrt{\hat{\gamma}_{ii}}}}{\sum_{i=1}^{N} \hat{\varphi}_i} \tag{29}$$

The above normalization by $\sqrt{\hat{\gamma}_{ii}}$ ensures proper expected energy as established in Eq. (2), i.e. $E\{|\hat{D}|^2\}=1$.

The phase angles $\angle\hat{D}[n]$ and $\hat{\theta}_i$ may be estimated at 376. Estimates of the per-channel phase shift $\hat{\theta}_i$ for a given channel i can be computed from the phase of the sample correlation coefficient $\angle\hat{\rho}_{x_i,\ x_j}$ which approximates the difference between the direct component phase shifts of channels i and j according to Eq. (9). To estimate absolute phase shifts $\hat{\theta}_i$ it is necessary to anchor a reference channel with a known absolute phase shift, chosen here as zero radians. Let the index l denote the channel with the largest DEF estimate $\hat{\phi}_i$, the per-channel phase shifts $\hat{\theta}_i$ for all channels i can then be computed as $$\hat{\theta}_i = \begin{cases} \angle\hat{\rho}_{x_i,x_l} & i \neq l \\ 0 & i = l \end{cases} \tag{30}$$

Computing the per-channel phase shift estimates $\hat{\theta}_i$ relative to channel l is motivated by the assumption that the estimated phase differences are more accurate for channels with high ratios of direct energy.

With estimates of the per-channel phase shifts $\hat{\theta}_i$ determined, estimates of the instantaneous phase $\angle\hat{D}[n]$ can be computed. Similar to the magnitude, the instantaneous phases of the direct and diffuse bases are stochastic for each time sample n. To estimate the instantaneous phase of the direct basis $\angle\hat{D}[n]$, a weighted average of the instantaneous phase of the observed signal $\angle X_i[n]$ can be computed across all channels i as $$\angle\hat{D}[n]=\angle\Sigma_{i=1}^{N}\hat{\phi}_i e^{j(\angle X_i[n]-\hat{\theta}_i)} \tag{31}$$

Similar to Eq. (29) the weights are chosen as the DEF estimates $\hat{\phi}_i$ to emphasize channels with higher ratios of direct energy. It is necessary to remove the per-channel phase shifts $\hat{\theta}_i$ from each channel i so that the instantaneous phases of the direct bases are aligned when averaging across channels.

At 378, the decomposed direct component output signal $Y_{D,i}[n]$ may be generated for each channel i using Eq. (27) and the estimates of $\hat{a}_i$ from 372, the estimate of $|\hat{D}[n]|$ from 374, and the estimates of $\angle\hat{D}[n]$ and $\hat{\theta}_i$ from 376. The decomposed diffuse component output signal may then be generated at 380 by applying the additive signal model as $$Y_{F,i}[n]=X_i[n]-Y_{D,i}[n] \tag{32}$$

Figure 4:
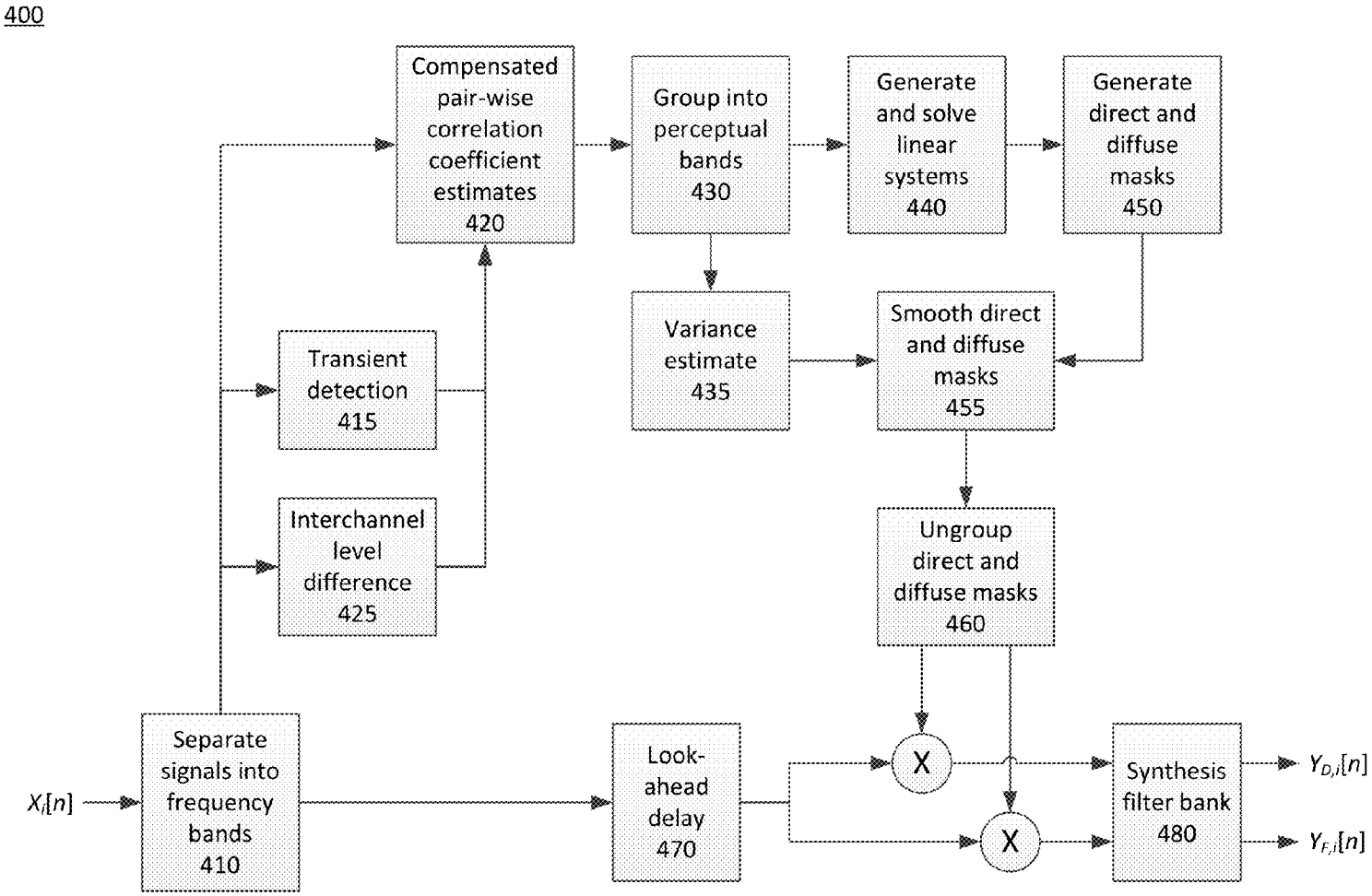
FIG. 4 is a flow chart of another process for direct-diffuse decomposition.

FIG. 4 is a flow chart of a process 400 for direct-diffuse decomposition of a multichannel signal $X_i[n]$ in a time-frequency framework. The process 400 is similar to the process 200. Actions 410, 420, 430, 440, 450, 460, 470, and 480 have the same function as the counterpart actions in the process 200. Descriptions of these actions will not be repeated in conjunction with FIG. 4.

The process 200 has been found to have difficulty identifying discrete components as direct components since the correlation coefficient equation is level independent. To remedy this problem, the correlation coefficient estimate for a given channel pair may be biased high if the pair contains a channel with relatively low energy. At 425, a difference in relative and/or absolute channel energy may be determined for each channel pair. The correlation coefficient estimate made at 420 for a channel pair may be biased high or overestimated if the relative or absolute energy difference between the pair exceeds a predetermined threshold. Alternatively, the DEFs calculated for example by using the actions 410, 420, 430, and 440 of the process 400, may be biased high or overestimated for a channel based on the estimated energy of the channel.

The process 200 has also been found to have difficulty identifying transient signal components as direct components since the correlation coefficient estimate is calculated over a relatively long temporal window. To remedy this problem, the correlation coefficient estimate for a given channel pair may be also biased high if the pair contains a channel with an identified transient. At 415, transients may be detected in each frequency band of each channel. The correlation coefficient estimate made at 420 for a channel pair may be biased high or overestimated if at least one channel of the pair is determined to contain a transient. Alternatively, the DEFs calculated for example by using the actions 410, 420, 430, and 440 of the process 400, may be biased high or overestimated for a channel determined to contain a transient.

The correlation coefficient estimate of purely diffuse signal components may have substantially higher variance than the correlation coefficient estimate of direct signals. The variance of the correlation coefficient estimates for the perceptual bands may be determined at 435. If the variance of the correlation coefficient estimates for a given channel pair in a given perceptual band exceeds a predetermined threshold variance value, the channel pair may be determined to contain wholly diffuse signals.

The direct and diffuse masks may be smoothed across time and/or frequency at 455 to reduce processing artifacts. For example, an exponentially-weighted moving average filter may be applied to smooth the direct and diffuse mask values across time. The smoothing can be dynamic, or variable in time. For example, a degree of smoothing may be dependent on the variance of the correlation coefficient estimates, as determined at 435. The mask values for channels having relatively low direct energy components may also be smoothed across frequency. For example, a geometric mean of mask values may be computed across a local frequency region (i.e. a plurality of adjacent frequency bands) and the average value may be used as the mask value for channels having little or no direct signal component.

Description of Apparatus

Figure 5:
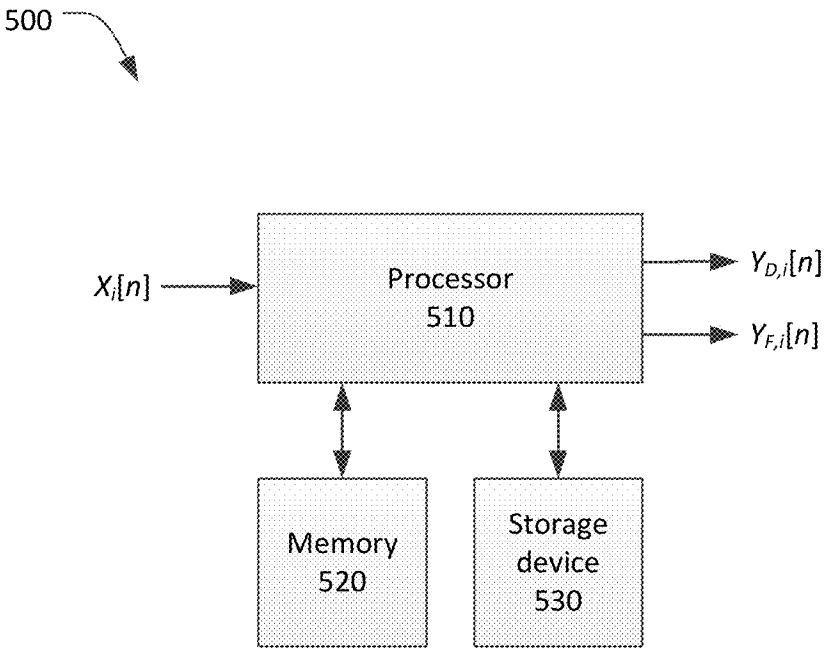
FIG. 5 is a block diagram of a computing device.

FIG. 5 is a block diagram of an apparatus 500 for direct-diffuse decomposition of a multichannel input signal $X_i[n]$. The apparatus 500 may include software and/or hardware for providing functionality and features described herein. The apparatus 500 may include a processor 510, a memory 520, and a storage device 530.

The processor 510 may be configured to accept the multichannel input signal $X_i[n]$ and output the direct component and diffuse component output signals, $Y_{D,i}[m, k]$ and $Y_{F,i}[m, k]$ respectively, for k frequency bands. The direct component and diffuse component output signals may be output as signals traveling over wires or another propagation medium to entities external to the processor 510. The direct component and diffuse component output signals may be output as data streams to another process operating on the processor 510. The direct component and diffuse component output signals may be output in some other manner.

The processor 510 may include one or more of: analog circuits, digital circuits, firmware, and one or more processing devices such as microprocessors, digital signal processors, field programmable gate arrays (FPGAs), application specific integrated circuits (ASICs), programmable logic devices (PLDs) and programmable logic arrays (PLAs). The hardware of the processor may include various specialized units, circuits, and interfaces for providing the functionality and features described here. The processor 510 may include multiple processor cores or processing channels capable of performing plural operations in parallel.

The processor 510 may be coupled to the memory 520. The memory 510 may be, for example, static or dynamic random access memory. The processor 510 may store data including input signal data, intermediate results, and output data in the memory 520.

The processor 510 may be coupled to the storage device 530. The storage device 530 may store instructions that, when executed by the processor 510, cause the apparatus 500 to perform the methods described herein. A storage device is a device that allows for reading and/or writing to a nonvolatile storage medium. Storage devices include hard disk drives, DVD drives, flash memory devices, and others. The storage device 530 may include a storage medium. These storage media include, for example, magnetic media such as hard disks, optical media such as compact disks (CD-ROM and CD-RW) and digital versatile disks (DVD and DVD±RW); flash memory devices; and other storage media. The term "storage medium" means a physical device for storing data and excludes transitory media such as propagating signals and waveforms.

Although shown as separate functional elements in FIG. 5 for ease of description, all portions of the processor 510, the memory 520, and the storage device 530 may be packaged within a single physical device such as a field programmable gate array or a digital signal processor circuit.

CLOSING COMMENTS

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for direct-diffuse decomposition of an input signal having three or more channels, comprising:

estimating correlation coefficients between each pair of channels from three or more channels;

constructing a linear system of equations relating the estimated correlation coefficients and direct energy fractions of each of the three or more channels;

solving the linear system to estimate the direct energy fractions; and generating a direct component output signal and a diffuse component output signal based in part on the direct energy fractions.

2. The apparatus of claim 1 further comprising:

separating each of the three or more channels into a plurality of frequency bands; and performing the estimating, constructing, solving, and generating independently for each of the plurality of frequency bands.

3. The method of claim 1, wherein each equation in the linear system has the form $$\log(|\rho_{x_i,x_j}|) = \frac{\log(\varphi_i) + \log(\varphi_j)}{2}$$

wherein:

$\rho_{x_i,x_j}$ is the correlation coefficient between channels i and j of the plurality of channels, and $\phi_i$ and $\phi_j$ are the direct energy fractions of channels i and j.

4. The method of claim 1, wherein estimating the correlation coefficient between each pair of channels is performed using a recursive formula.

5. The method of claim 4, further comprising:

compensating the recursive correlation coefficient estimates by setting correlation coefficient estimates below a predetermined value to zero, and linearly expanding the range of correlation coefficient estimates greater than or equal to the predetermined value to the range [0, 1].

6. The method of claim 1, wherein generating a direct component output signal and a diffuse component output signal further comprises:

generating direct and diffuse masks based on the direct energy fractions of each of the three or more channels; and multiplying the input signal by the direct and diffuse masks to provide the direct component output signal and the diffuse component output signal.

7. The method of claim 1, wherein generating a direct component output signal and a diffuse component output signal further comprises:

estimating a magnitude and phase angle of a direct basis based on, in part, the direct energy fractions of the three or more channels;

estimating a direct component energy and phase shift for each of the three or more channels based, in part, on the respective direct energy fraction; and generating a direct component output signal for each of the three or more channels from the respective direct component energy and phase shift and the magnitude and phase angle of the direct basis.

8. The method of claim 7, further comprising:

estimating a diffuse component output signal for each of the three or more channels by subtracting the respective estimated direct component from a respective channel.

9. The method of claim 1, wherein solving the linear system further comprises:

using one of a linear least square method and a weighted least squares method to solve an overdetermined system of equations.

10. A method for direct-diffuse decomposition of an input signal having three or more input signal channels, comprising:

separating each of the three or more input signal channels into a plurality of frequency bands, estimating correlation coefficients between each pair of input signal channels from the three or more input signal channels for each of the plurality of frequency bands;

constructing linear systems of equations relating the estimated correlation coefficients and direct energy fractions for each of the plurality of frequency bands;

solving the linear systems to estimate the direct energy fractions for each of the of three or more input signal channels for each of the plurality of frequency bands; and generating a direct component output signal and a diffuse component output signal for each of the plurality of frequency bands based in part on the direct energy fractions.

11. The method of claim 10, wherein each equation in the linear system for each of the plurality of frequency bands has the form $$\log(|\rho_{x_i,x_j}|) = \frac{\log(\varphi_i) + \log(\varphi_j)}{2}$$

wherein:

$\rho_{x_i,x_j}$ is the correlation coefficient between input signal channels i and j of the plurality of input signal channels, and $\phi_i$ and $\phi_j$ are the direct energy fractions of input signal channels i and j.

12. The method of claim 11, wherein estimating the correlation coefficient between each pair of input signal channels is performed using a recursive formula.

13. The method of claim 12, further comprising:

compensating the recursive correlation coefficient estimates by setting correlation coefficient estimates below a predetermined value to zero, and linearly expanding the range of correlation coefficient estimates greater than or equal to the predetermined value to the range [0, 1].

14. The method of claim 10, wherein generating a direct component output signal and a diffuse component output signal further comprises:

generating direct and diffuse masks for each of the plurality of frequency bands based on the direct energy fractions of each of the three or more input signal channels; and for each of the plurality of frequency bands, multiplying the input signal by the direct and diffuse masks to provide the direct component output signal and the diffuse component output signal.

15. The method of claim 14, further comprising:

smoothing the direct and diffuse masks across time and/or frequency.

16. The method of claim 15, wherein smoothing the direct and diffuse masks further comprises:

smoothing the direct and diffuse mask based, in part, on an estimate of the variance of the correlation coefficient estimates for the three or more input signal channels and plurality of frequency bands.

17. The method of claim 10, wherein estimating the correlation coefficient between a pair of input signal channels from the three or more input signal channels in one of the plurality of frequency bands further comprises:

if a difference between the pair of input signal channels exceeds a predetermined threshold, overestimating the correlation coefficient between the pair of input signal channels.

18. The method of claim 10, wherein estimating the correlation coefficient between a pair of signals from the three or more input signal channels in one of the plurality of frequency bands further comprises:

if one of the pair of input signal channels includes a transient, overestimating the correlation coefficient between the pair of input signal channels.

19. The method of claim 10, wherein solving the linear systems further comprises:

using one of a linear least square method and a weighted least squares method to solve an overdetermined system of equations.

20. An apparatus for direct-diffuse decomposition of an input signal having three or more channels, comprising:

a processor;

a memory coupled to the processor; and a storage device coupled to the processor, the storage device storing instructions that, when executed by the processor, cause the computing device to perform actions including:

estimating the correlation coefficient between each pair of channels from the three or more channels;

constructing a linear system of equations relating the estimated correlation coefficients and direct energy fractions of each of the three or more channels;

solving the linear system to estimate the direct energy fractions; and generating a direct component output signal and a diffuse component output signal based in part on the direct energy fractions.

* * * * *